US008188719B2

(12) United States Patent
Sudou

(10) Patent No.: US 8,188,719 B2
(45) Date of Patent: May 29, 2012

(54) VOLTAGE REGULATOR

(75) Inventor: Minoru Sudou, Austin, TX (US)

(73) Assignee: Seiko Instruments Inc., Chiba (JP)

( * ) Notice: Subject to any disclaimer, the term of this patent is extended or adjusted under 35 U.S.C. 154(b) by 252 days.

(21) Appl. No.: 12/790,019

(22) Filed: May 28, 2010

(65) Prior Publication Data

US 2011/0291636 A1 Dec. 1, 2011

(51) Int. Cl.
*G05F 1/10* (2006.01)
*G05F 1/40* (2006.01)

(52) U.S. Cl. ..... 323/242; 323/274; 323/284; 323/288

(58) Field of Classification Search ..... 323/237, 323/238, 242, 246, 274–276, 280–288
See application file for complete search history.

(56) References Cited

U.S. PATENT DOCUMENTS

| | | | | |
|---|---|---|---|---|
| 7,208,924 | B2 * | 4/2007 | Toyoshima et al. | 323/271 |
| 7,294,994 | B2 * | 11/2007 | Ryu et al. | 323/282 |
| 7,868,602 | B2 * | 1/2011 | Omi et al. | 323/284 |
| 2008/0238394 | A1 * | 10/2008 | Hasegawa et al. | 323/283 |
| 2010/0045252 | A1 * | 2/2010 | Yamamoto | 323/282 |

FOREIGN PATENT DOCUMENTS

JP 04-195613 A 7/1992

* cited by examiner

*Primary Examiner* — Jessica Han
(74) *Attorney, Agent, or Firm* — Brinks Hofer Gilson & Lione

(57) ABSTRACT

Provided is a voltage regulator capable of stable operation under a light load so as to cover a wide range of load capacitances. The voltage regulator includes a circuit for charging a phase compensation capacitor for the voltage regulator, and a zero due to a resistor (104) and a capacitor (106) appears at low frequency.

6 Claims, 10 Drawing Sheets

VOLTAGE REGULATOR

BACKGROUND OF THE INVENTION

1. Field of the Invention

The present invention relates to a voltage regulator that is capable of stable operation even under a light load so as to cover a wide range of load capacitances.

2. Description of the Related Art

As a conventional voltage regulator 100, a circuit illustrated in FIG. 7 is known (see, for example, Japanese Patent Application Laid-open No. 1992-195613 (FIG. 1)).

A power supply voltage of a battery 120 is applied between a VDD terminal 121 and a VSS terminal 123. A load 125 and a load capacitor 126 are connected to a VOUT terminal 124.

A reference voltage circuit 101 outputs a constant voltage to be applied to an inverting input terminal of an error amplifier 102. A voltage of the VOUT terminal 124 is divided by means of resistors 104 and 105, and the divided voltage is applied to a non-inverting input terminal of the error amplifier 102. An output transistor 103 has a source connected to the VDD terminal 121, a drain connected to the VOUT terminal 124, and a gate connected to an output of the error amplifier 102. The output transistor 103 accordingly has a resistance controlled based on the output of the error amplifier 102. In other words, the following control is made so that a constant voltage may be output to the VOUT terminal 124. If a voltage determined by dividing the output voltage of the VOUT terminal 124 by means of the resistors 104 and 105 is lower than the output voltage of the reference voltage circuit 101, the output of the error amplifier 102 becomes low to strongly bias the output transistor 103 so that the output transistor 103 may be reduced in resistance to thereby increase the voltage of the VOUT terminal 124. On the other hand, if the voltage determined by dividing the above-mentioned voltage by means of the resistors 104 and 105 is higher than the reference voltage, the output transistor 103 is weakly biased to have a large resistance to thereby reduce the voltage of the VOUT terminal 124.

A CE circuit 110 controls ON/OFF of the voltage regulator based on a voltage applied to a CE terminal 122.

A capacitor 106 is connected in parallel to the resistor 104 and performs phase compensation on the voltage regulator.

FIG. 8A is a circuit focusing on the resistors 104 and 105 and the capacitor 106 of the voltage regulator.

When the voltage of the VOUT terminal 124 and the voltage of a connection point between the resistors 104 and 105 are represented by Vout and Vfb, respectively, a transfer function from the VOUT terminal 124 to the connection point between the resistors 104 and 105 is derived from Expressions (1) to (3).

[Expression 1]

$$\frac{V_{FB}}{V_{OUT}} = \frac{R_2}{R_1 + R_2} \cdot \frac{1 + \frac{s}{fz}}{1 + \frac{s}{fp}} \tag{1}$$

[Expression 2]

$$fz = \frac{1}{2 \times \pi \times Cz \times R_1} \tag{2}$$

[Expression 3]

$$fp = \frac{1}{2 \times \pi \times Cz \times \frac{R_1 \times R_2}{R_1 + R_2}} \tag{3}$$

where $R_1$ and $R_2$ represent respective resistances of the resistors 104 and 105, and Cz represents a capacitance of the capacitor 106. In other words, there are a zero and a pole, which are derived from Expressions (2) and (3), respectively.

FIGS. 8B and 8C illustrate a gain Bode plot and a phase Bode plot of the transfer function, which is derived from Expression (1). As illustrated in FIG. 8C, as a frequency increases, a phase is advanced from 0 degrees by 45 degrees at a zero frequency fz, and is further advanced to 90 degrees at a maximum. Then, the phase becomes 45 degrees at a pole frequency fp, and returns to 0 degrees again. In other words, the phase advancing effect is exerted in a range from around the frequency fz to around the frequency fp.

FIG. 9 illustrates a Bode plot of the voltage regulator having two poles.

The output terminal 124 of the voltage regulator is connected to the load 125 and the load capacitance 126, and accordingly a pole appears. In a case where the load 125 is light and accordingly the load capacitance 126 is large, the pole appears at low frequency, leading to a narrow bandwidth of the voltage regulator. In addition, there is another pole in the error amplifier 102, and hence a phase is delayed by 180 degrees at low frequency, resulting in no phase margin (phase margin of near 0). In this case, a bandwidth fbw of the voltage regulator is reduced to, for example, approximately 100 Hz.

FIG. 10 illustrates a Bode plot of the voltage regulator having three poles and one zero, which is obtained when appropriate phase compensation is performed by the resistors 104 and 105 and the capacitor 106. A zero (frequency fz) appears around a pole frequency fp2 so that a phase margin of, for example, 30 degrees or more may be secured at a gain of 0 dB or more.

However, the conventional voltage regulator involves a problem of being incapable of stable operation under a light load to cover a wide range of load capacitances.

In order to lower the zero frequency to approximately 100 Hz, as apparent from Expression (2), a time constant $Cz \times R_1$ of the order of milliseconds is required. However, in the conventional voltage regulator illustrated in FIG. 7, if the time constant $Cz \times R_1$ is of the order of milliseconds, the start-up of the voltage regulator takes a time period of the order of milliseconds after change of the CE terminal voltage from "L" to "H", as illustrated in FIG. 11B. Therefore, there is another problem that the voltage regulator cannot be used for applications where quick start-up is required.

SUMMARY OF THE INVENTION

It is therefore an object of the present invention to solve the conventional problems, and to provide a voltage regulator that is capable of stable operation even under a light load so as to cover a wide range of load capacitances.

A voltage regulator according to the present invention includes: a first power supply terminal; a second power supply terminal; an output terminal; a reference voltage circuit; a first resistor and a second resistor that are connected in series between the output terminal and the second power supply terminal; a first error amplifier circuit for outputting a voltage determined based on a reference voltage that is supplied to its inverting input and a voltage of a connection point between the first resistor and the second resistor that is supplied to its non-inverting input; a metal oxide semiconductor (MOS) transistor having a gate voltage that is controlled by an output of the first error amplifier circuit so that the output terminal has a constant voltage value, the MOS transistor being provided between the first power supply terminal and the output terminal; a phase compensation capacitor including one terminal connected to the output terminal; a second error amplifier circuit having: a non-inverting input connected to the connection point between the first resistor and the second resistor; and an output and an inverting input that are connected to each other; and a switch circuit configured to: connect the phase compensation capacitor to an output of the second error amplifier circuit until a predetermined time period elapses after one of power-on and turn-on of the voltage regulator; and connect the phase compensation capacitor to the connection point between the first resistor and the second resistor after the predetermined time period has elapsed.

According to the voltage regulator of the present invention, the start-up time of the voltage regulator may be shortened while enabling stable operation under a light load so as to cover a wide range of load capacitances.

BRIEF DESCRIPTION OF THE DRAWINGS

In the accompanying drawings:

FIGS. 11A to 11C illustrate start-up characteristics of a voltage regulator after power-on.

DETAILED DESCRIPTION OF THE PREFERRED EMBODIMENTS

First Embodiment

Figure 1:
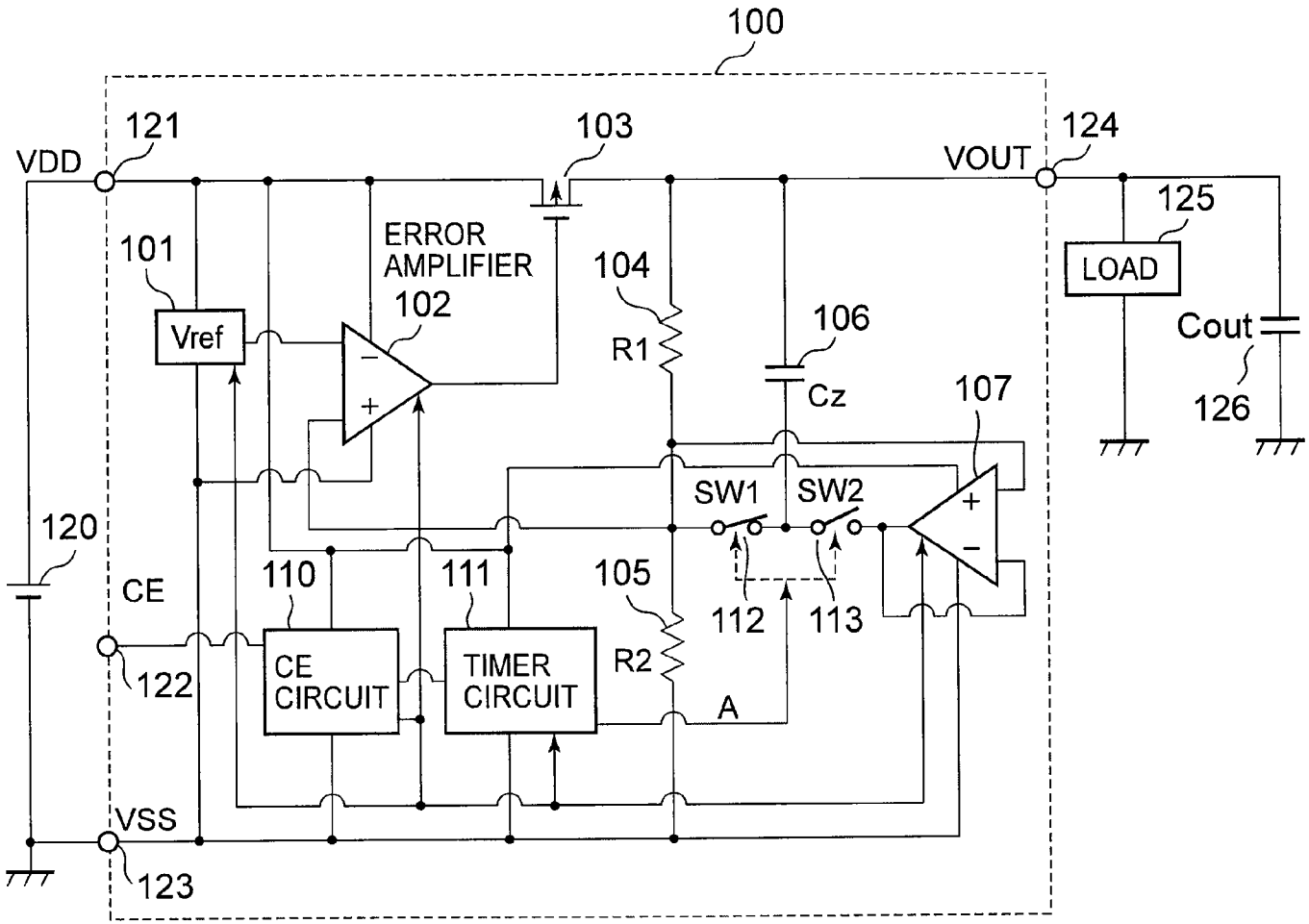
FIG. 1 is a circuit diagram illustrating a voltage regulator according to a first embodiment of the present invention.
Figure 2A:
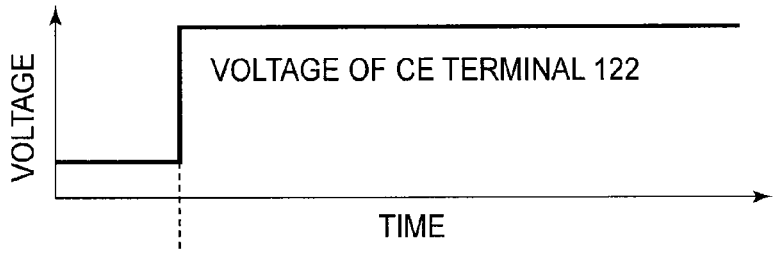
FIGS. 2A to 2D are a timing chart of the voltage regulator according to the first embodiment.
Figure 2B:
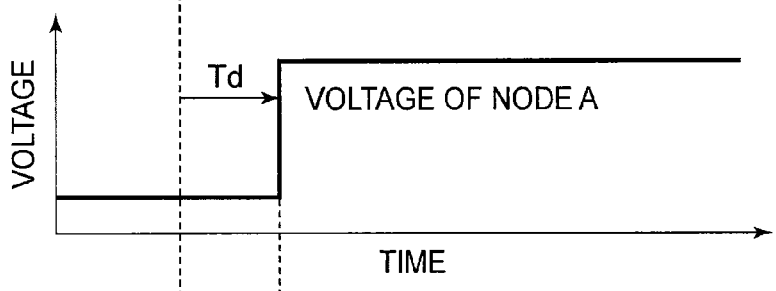
Figure 2C:
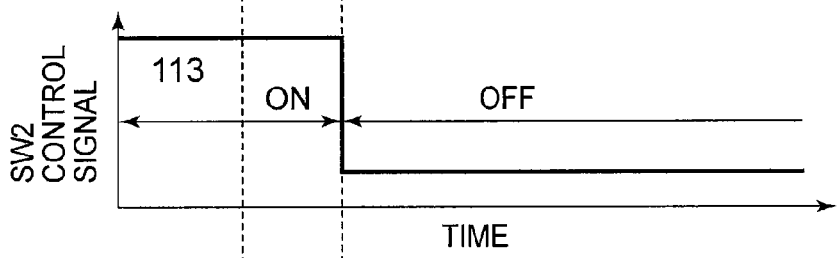
Figure 2D:
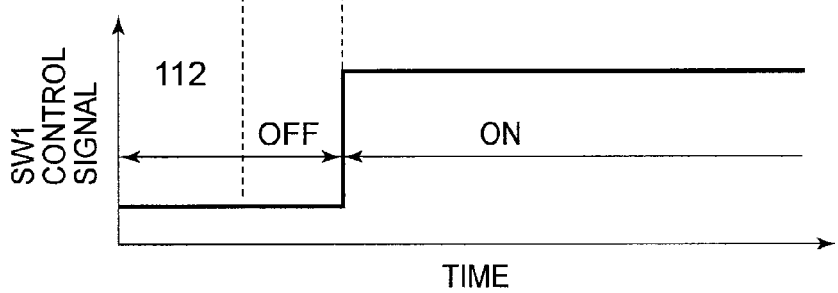

FIG. 1 is a circuit diagram illustrating a voltage regulator according to a first embodiment of the present invention. The voltage regulator according to the first embodiment includes a reference voltage circuit 101, an error amplifier 102, a resistor 104, a resistor 105, a capacitor 106, an output transistor (P-channel transistor) 103, a switch 112, a switch 113, an error amplifier 107, a CE circuit 110, a timer circuit 111, a VDD terminal 121, a CE terminal 122, a VSS terminal 123, and an output terminal (VOUT terminal) 124.

Connection in the voltage regulator according to the first embodiment is described. An output of the reference voltage circuit 101 is connected to an inverting input terminal of the error amplifier 102. A non-inverting input terminal of the error amplifier 102 is connected to a connection point between one terminal of the resistor 104 and one terminal of the resistor 105. An output of the error amplifier 102 is connected to a gate of the P-channel transistor 103. Another terminal of the resistor 104 is connected to the VOUT terminal 124, and another terminal of the resistor 105 is connected to the VSS terminal 123. A source of the P-channel transistor 103 is connected to the VDD terminal 121, and a drain thereof is connected to the output terminal 124.

One terminal of the capacitor 106 is connected to the VOUT terminal 124, and another terminal thereof is connected to one terminal of the switch 112 and one terminal of the switch 113. Another terminal of the switch 112 is connected to the connection point between the one terminal of the resistor 104 and the one terminal of the resistor 105. Another terminal of the switch 113 is connected to an output of the error amplifier 107. A non-inverting input terminal of the error amplifier 107 is connected to the connection point between the one terminal of the resistor 104 and the one terminal of the resistor 105, and an inverting input terminal thereof is connected to the output of the error amplifier 107.

An output of the CE circuit 110 is input to the timer circuit 111, the reference voltage circuit 101, the error amplifier 102, and the error amplifier 107. An input of the CE circuit 110 is connected to the CE terminal 122. An output of the timer circuit 111 is connected to the switches 112 and 113 to control ON/OFF thereof.

The CE circuit 110 controls ON/OFF of the voltage regulator based on a voltage applied to the CE terminal 122. The resistor 104 and the capacitor 106 together perform phase compensation on the voltage regulator. The resistor 104 and the capacitor 106 are set to have large resistance and capacitance, respectively, to thereby lower a zero frequency fz.

Next, referring to a timing chart of FIGS. 2A to 2D, an operation of the voltage regulator according to the first embodiment is described. At first, when the voltage of the CE terminal 122 is "L", the voltage regulator is in an OFF state (suspended state). Further, the switch 112 is in an OFF state (open) while the switch 113 is in an ON state (short-circuited). When the voltage of the CE terminal 122 becomes "H" thereafter, the voltage regulator starts up to enter an ON state (operating state). Then, the timer circuit 111 keeps the switch 112 in the OFF state (open) and the switch 113 in the ON state (short-circuited) during an arbitrary time period Td. After the time period Td has elapsed, the timer circuit 111 generates a signal that keeps the switch 112 in the ON state (short-circuited) and the switch 113 in the OFF state (open). In other words, during the time period Td, the output of the error amplifier 107 charges the capacitor 106 to the same voltage as a voltage of the connection point between the one terminal of the resistor 104 and the one terminal of the resistor 105. After the time period Td has elapsed, the switch 113 is turned OFF while the switch 112 is turned ON, and accordingly a zero due to the resistor 104 and the capacitor 106 appears so that the capacitor 106 may contribute to the phase compensation of the voltage regulator.

Figure 8A:
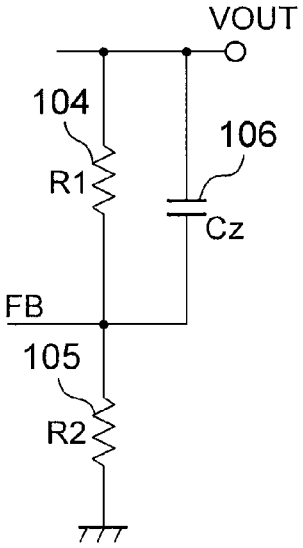
FIGS. 8A to 8C illustrate gain/phase characteristics of a voltage dividing circuit.
Figure 8B:
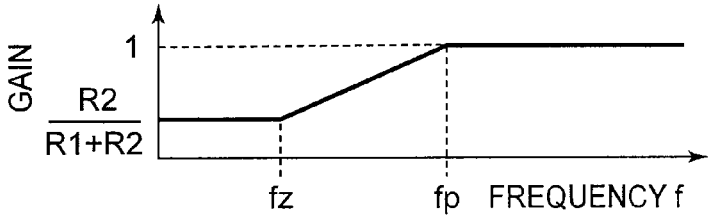
Figure 8C:
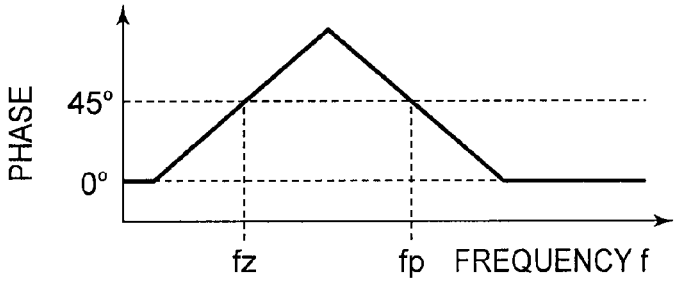
Figure 9:
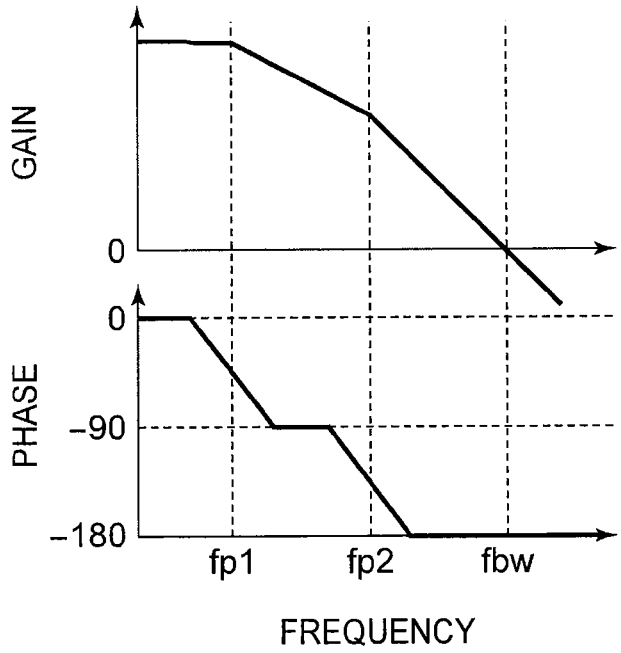
FIG. 9 is a Bode plot of the voltage regulator having two poles.
Figure 10:
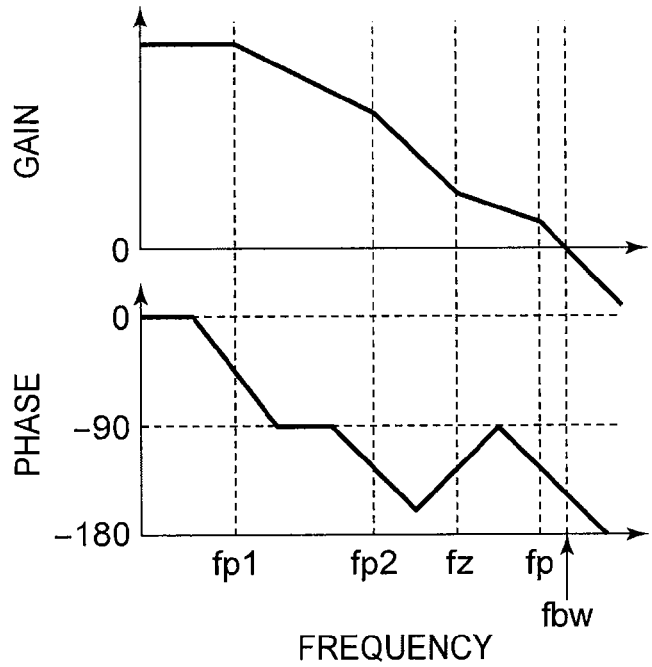
FIG. 10 is a Bode plot of the voltage regulator having three poles and one zero.
Figure 11A:
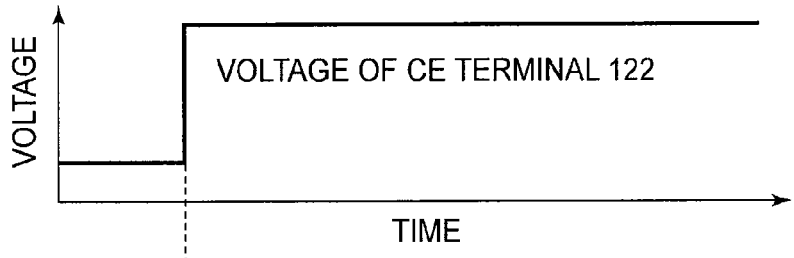
Figure 11B:
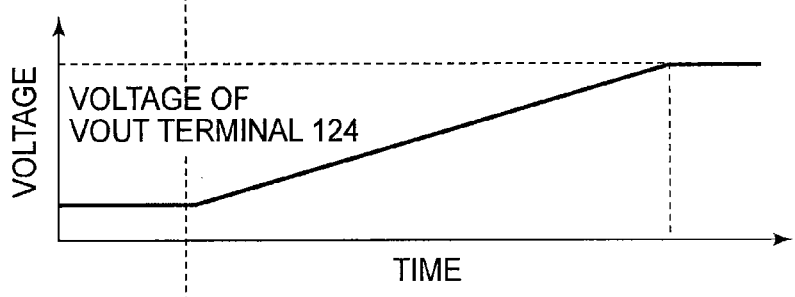
Figure 11C:
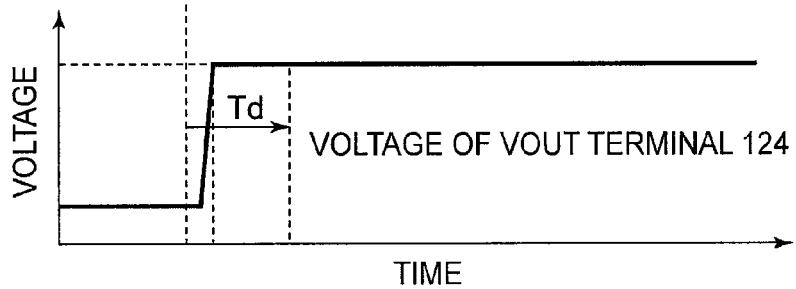

In other words, until the time period Td elapses after power-on or change of the CE terminal voltage from "L" to "H", the switch 113 is turned ON so that the capacitor 106 may be charged by the output of the error amplifier 107 to the same voltage as the voltage of the connection point between the one terminal of the resistor 104 and the one terminal of the resistor 105. Therefore, as illustrated in FIG. 11C, the start-up time of the voltage regulator may be shortened. Because the switch 113 is turned OFF and the switch 112 is turned ON after the time period Td has elapsed, such a phase compensation effect as illustrated in FIGS. 8A to 8C can be obtained.

As described above, according to the voltage regulator of the first embodiment, the start-up time of the voltage regulator may be shortened during the time period Td. Further, after the time period Td has elapsed, a zero due to the resistor 104 and the capacitor 106 appears to thereby enable stable operation of the voltage regulator under a light load so as to cover a wide range of load capacitances.

Note that, a time constant of the resistor 104 and the capacitor 106 may be set to 1 millisecond or more.

Second Embodiment

Figure 3:
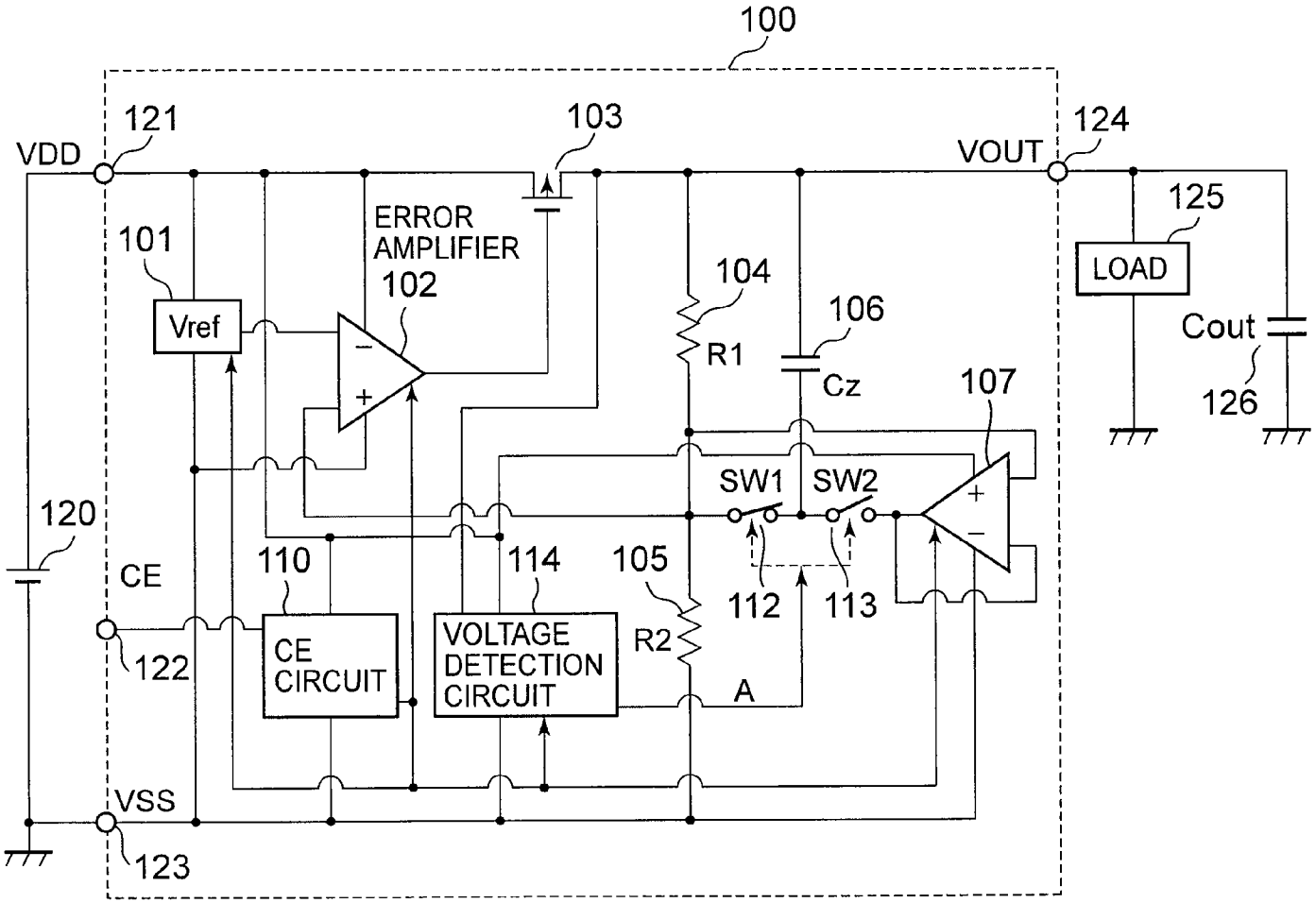
FIG. 3 is a circuit diagram illustrating a voltage regulator according to a second embodiment of the present invention.
Figure 4A:
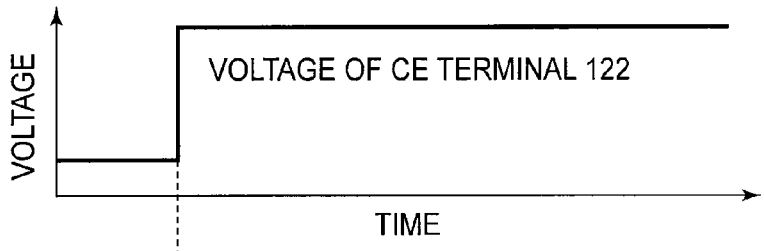
FIGS. 4A to 4D are a timing chart of the voltage regulator according to the second embodiment.
Figure 4B:
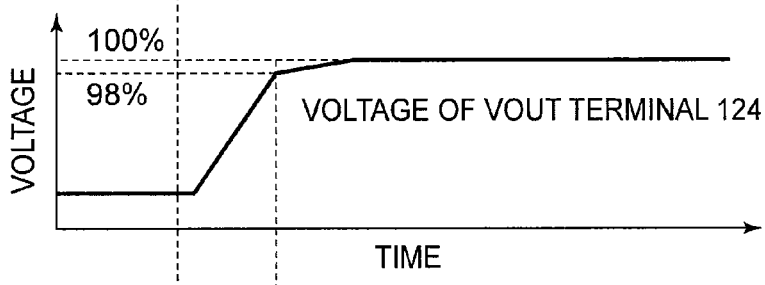
Figure 4C:
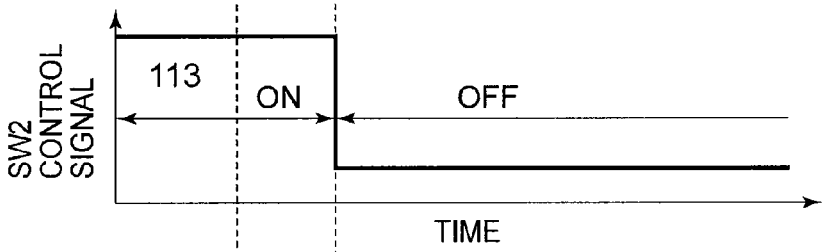
Figure 4D:
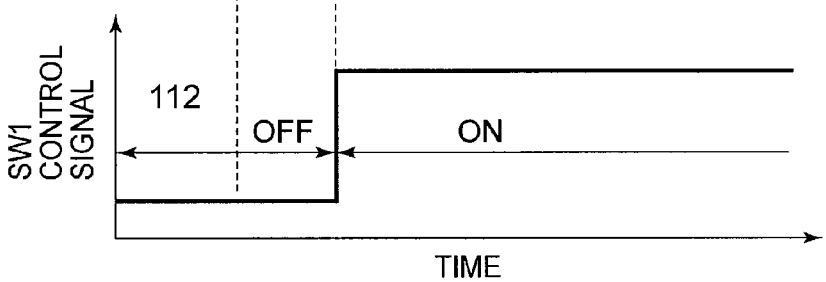

FIG. 3 is a circuit diagram illustrating a voltage regulator according to a second embodiment of the present invention. FIG. 3 is different from FIG. 1 in that the switches 112 and 113 are controlled by an output of a voltage detection circuit 114. The voltage detection circuit 114 monitors the voltage of the VOUT terminal 124 to detect whether or not the voltage of the VOUT terminal 124 has reached a certain voltage value, and outputs a switch control signal.

Next, referring to a timing chart of FIGS. 4A to 4D, an operation of the voltage regulator according to the second embodiment is described. At first, when the voltage of the CE terminal 122 is "L", the voltage regulator is in the OFF state (suspended state). Further, the switch 112 is in the OFF state (open) while the switch 113 is in the ON state (short-circuited). When the voltage of the CE terminal 122 becomes "H" thereafter, the voltage regulator starts up to enter the ON state (operating state). Then, the error amplifier 102 controls a gate voltage of the output transistor 103 so that the output voltage of the reference voltage circuit 101 and the voltage of the connection point between the one terminal of the resistor 104 and the one terminal of the resistor 105 may be equal to each other. As a result, the voltage regulator outputs a voltage (Vout) derived from Expression (4).

[Expression 4]

$$Vout = \frac{R_1 + R_2}{R_2} \times Vref \tag{4}$$

where Vref represents an output voltage value of the reference voltage circuit 101. The voltage detection circuit 114 detects whether or not the voltage of the VOUT terminal 124 is, for example, 98% or less of the voltage derived from Expression (4). Then, when the voltage of the VOUT terminal 124 is 98% or less of the above-mentioned voltage, the voltage detection circuit 114 generates a signal that keeps the switch 112 in the OFF state (open) and the switch 113 in the ON state (short-circuited). When the voltage of the VOUT terminal 124 exceeds 98% of the above-mentioned voltage, the voltage detection circuit 114 generates a signal that keeps the switch 112 in the ON state (short-circuited) and the switch 113 in the OFF state (open). In other words, when the VOUT terminal 124 has a voltage value of 98% or less of Vout, the output of the error amplifier 107 charges the capacitor 106 to the same voltage as in the connection point between the one terminal of the resistor 104 and the one terminal of the resistor 105. When the VOUT terminal 124 has a voltage value exceeding 98% of Vout, the switch 113 is turned OFF while the switch 112 is turned ON, and accordingly a zero due to the resistor 104 and the capacitor 106 appears so that the capacitor 106 may contribute to the phase compensation of the voltage regulator. In this way, when the voltage value of the VOUT terminal 124 is 98% or less of Vout after the power-on or the change of the CE terminal voltage from "L" to "H", the start-up time of the voltage regulator may be shortened. Then, after the voltage value of the VOUT terminal 124 has exceeded 98% of Vout, such a phase compensation effect as illustrated in FIGS. 8A to 8C can be obtained.

As described above, according to the voltage regulator of the second embodiment, the start-up time of the voltage regulator may be shortened until the voltage of the VOUT terminal 124 reaches, for example, 98% of Vout. Further, after the voltage of the VOUT terminal 124 has exceeded, for example, 98% of Vout, a zero due to the resistor 104 and the capacitor 106 appears to thereby enable stable operation of the voltage regulator under a light load so as to cover a wide range of load capacitances.

Note that, the voltage detection circuit 114 may be set to have an arbitrary detection voltage. Besides, the time constant of the resistor 104 and the capacitor 106 may be set to 1 millisecond or more.

Third Embodiment

Figure 5:
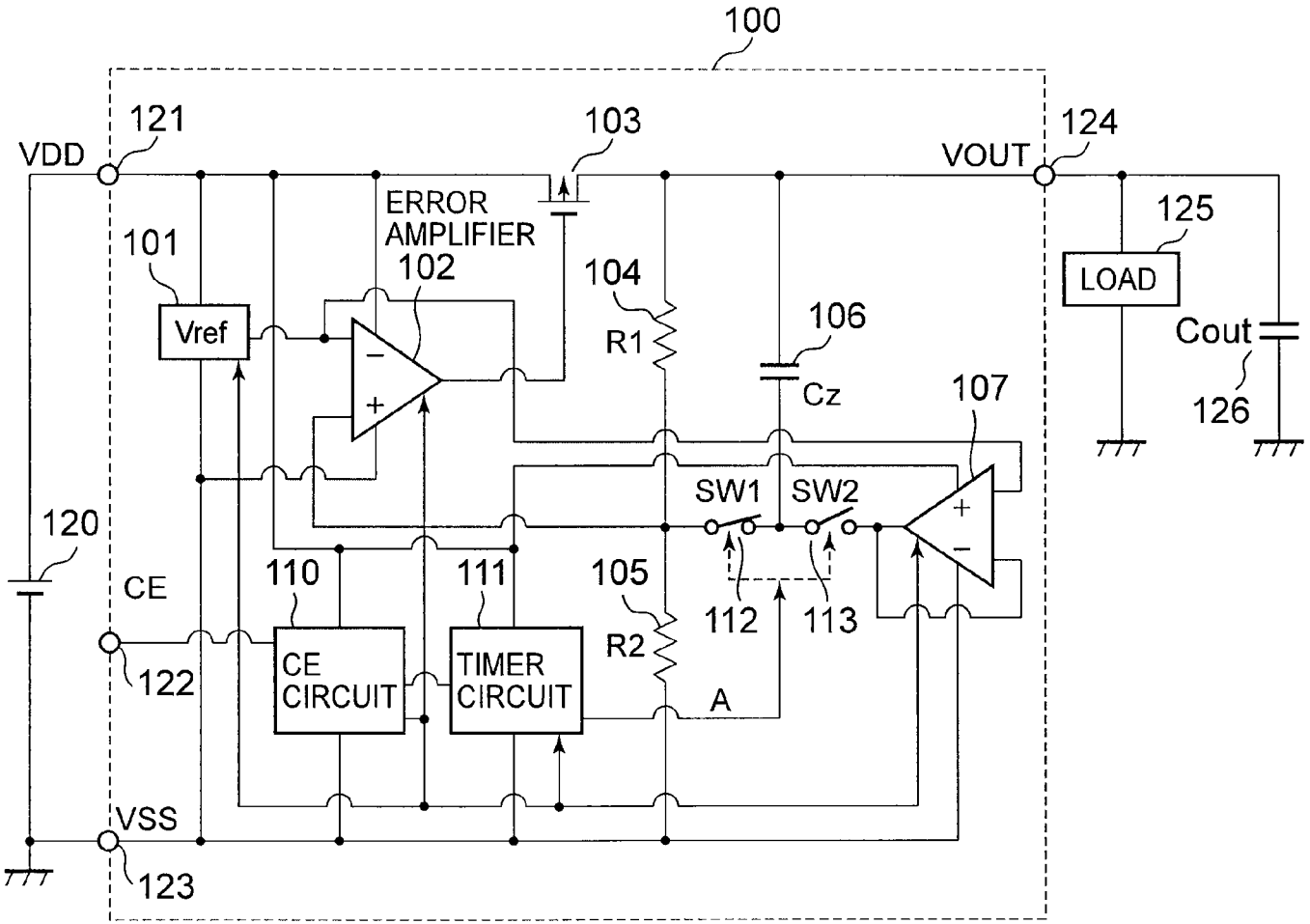
FIG. 5 is a circuit diagram illustrating a voltage regulator according to a third embodiment of the present invention.

FIG. 5 is a circuit diagram illustrating a voltage regulator according to a third embodiment of the present invention. FIG. 5 is different from FIG. 1 in that the non-inverting input terminal of the error amplifier 107 is connected to the output of the reference voltage circuit 101. Regarding an operation, after the time period Td has elapsed, a voltage across the another terminal of the capacitor 106 and the VOUT terminal 124 becomes equal to an output voltage value of the reference voltage circuit 101. Therefore, the same effect can be obtained because the voltage regulator performs the same operation as in the voltage regulator of FIG. 1 after the time period Td has elapsed.

As described above, according to the voltage regulator of the third embodiment, the start-up time of the voltage regulator may be shortened during the time period Td. Further, after the time period Td has elapsed, a zero due to the resistor 104 and the capacitor 106 appears to thereby enable stable operation of the voltage regulator under a light load so as to cover a wide range of load capacitances.

Note that, the time constant of the resistor 104 and the capacitor 106 may be set to 1 millisecond or more.

Fourth Embodiment

Figure 6:
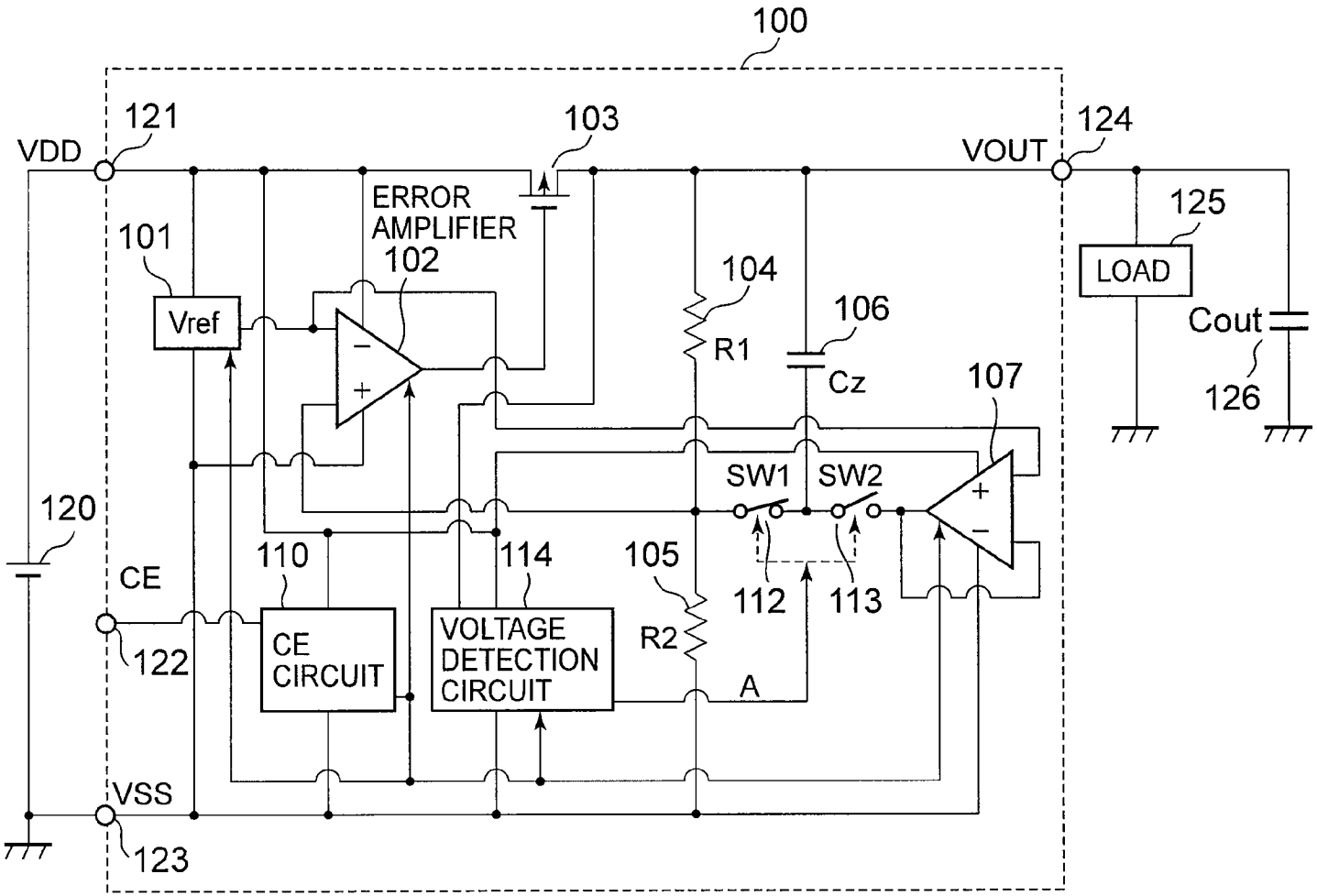
FIG. 6 is a circuit diagram illustrating a voltage regulator according to a fourth embodiment of the present invention.
Figure 7:
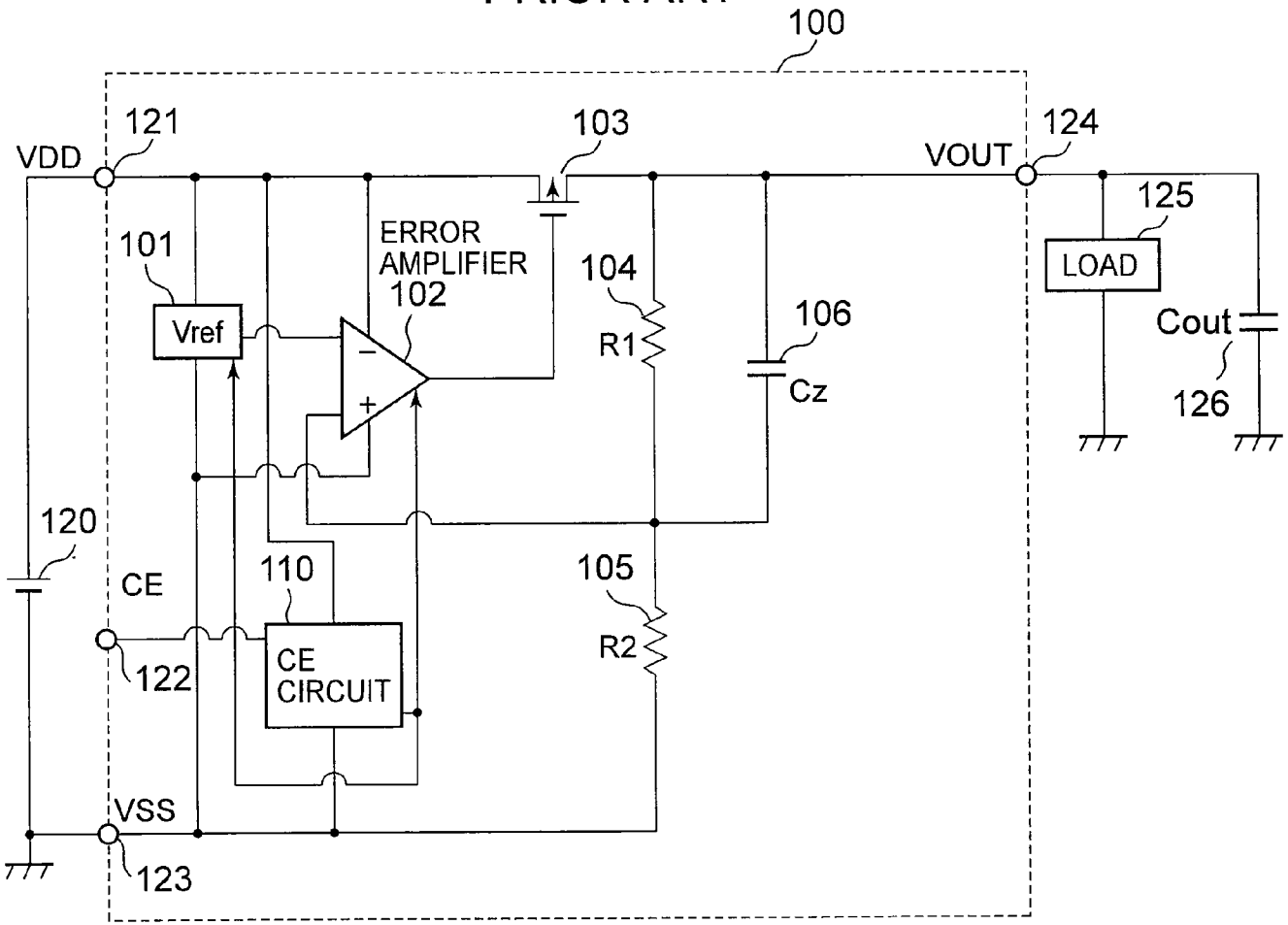
FIG. 7 PRIOR ART
FIG. 7 is a circuit diagram illustrating a conventional voltage regulator.

FIG. 6 is a circuit diagram illustrating a voltage regulator according to a fourth embodiment of the present invention. FIG. 6 is different from FIG. 3 in that the non-inverting input terminal of the error amplifier 107 is connected to the output of the reference voltage circuit 101. Regarding an operation, after the time period Td has elapsed, the voltage across the another terminal of the capacitor 106 and the VOUT terminal 124 becomes equal to the output voltage value of the reference voltage circuit 101. Therefore, the same effect can be obtained because the voltage regulator performs the same operation as in the voltage regulator of FIG. 3 after the time period Td has elapsed.

As described above, according to the voltage regulator of the fourth embodiment, the start-up time of the voltage regulator may be shortened until the voltage of the VOUT terminal 124 reaches, for example, 98% of Vout. Further, after the voltage of the VOUT terminal 124 has exceeded, for example, 98% of Vout, a zero due to the resistor 104 and the capacitor 106 appears to thereby enable stable operation of the voltage regulator under a light load so as to cover a wide range of load capacitances.

Note that, the voltage detection circuit 114 may be set to have an arbitrary detection voltage. Besides, the time constant of the resistor 104 and the capacitor 106 may be set to 1 millisecond or more.

As described above, according to the voltage regulator of the present invention, the start-up time of the voltage regulator may be shortened while enabling stable operation under a light load so as to cover a wide range of load capacitances.

Note that, all the embodiments have exemplified the configuration provided with the CE circuit 110, which is connected to the CE terminal 122. However, the same effect can also be obtained in a configuration in which a circuit for detecting a power supply voltage (for example, power-on clear circuit) is provided instead of the CE circuit 110.

What is claimed is:

1. A voltage regulator, comprising:
a first power supply terminal;
a second power supply terminal;
an output terminal;
a reference voltage circuit;
a first resistor and a second resistor that are connected in series between the output terminal and the second power supply terminal;
a first error amplifier circuit for outputting a voltage indicating a comparison result,
the first error amplifier circuit including:
an inverting input terminal connected to an output terminal of the reference voltage circuit; and
a non-inverting input terminal connected to a connection point between the first resistor and the second resistor;
an output transistor having a gate voltage that is controlled by an output of the first error amplifier circuit so that the output terminal has a constant voltage value,
the output transistor being provided between the first power supply terminal and the output terminal;
a phase compensation capacitor including one terminal connected to the output terminal;
a second error amplifier circuit including:
a non-inverting input terminal connected to the connection point between the first resistor and the second resistor; and
an output terminal and an inverting input terminal that are connected to each other; and
a switch circuit configured to:
connect the phase compensation capacitor to an output of the second error amplifier circuit until a predetermined time period elapses after one of power-on and turn-on of the voltage regulator; and
connect the phase compensation capacitor to the connection point between the first resistor and the second resistor after the predetermined time period has elapsed.

2. A voltage regulator according to claim 1, wherein the non-inverting input terminal of the second error amplifier circuit is connected to the output terminal of the reference voltage circuit.

3. A voltage regulator according to claim 1, wherein the first resistor and the phase compensation capacitor have a time constant of 1 millisecond or more.

4. A voltage regulator, comprising:
a first power supply terminal;
a second power supply terminal;
an output terminal;
a reference voltage circuit;
a first resistor and a second resistor that are connected in series between the output terminal and the second power supply terminal;
a first error amplifier circuit for outputting a voltage indicating a comparison result,
the first error amplifier circuit including:
an inverting input terminal connected to an output terminal of the reference voltage circuit; and
a non-inverting input terminal connected to a connection point between the first resistor and the second resistor;
an output transistor having a gate voltage that is controlled by an output of the first error amplifier circuit so that the output terminal has a constant voltage value,
the output transistor being provided between the first power supply terminal and the output terminal;
a phase compensation capacitor including one terminal connected to the output terminal;
a second error amplifier circuit including:
a non-inverting input terminal connected to the connection point between the first resistor and the second resistor; and
an output terminal and an inverting input terminal that are connected to each other; and
a switch circuit configured to:
connect the phase compensation capacitor to an output of the second error amplifier circuit as long as an output voltage of the voltage regulator is lower than a predetermined voltage value after one of power-on and turn-on of the voltage regulator; and
connect the phase compensation capacitor to the connection point between the first resistor and the second resistor when the output voltage has the predetermined voltage value or more.

5. A voltage regulator according to claim 4, wherein the non-inverting input terminal of the second error amplifier circuit is connected to the output terminal of the reference voltage circuit.

6. A voltage regulator according to claim 4, wherein the first resistor and the phase compensation capacitor have a time constant of 1 millisecond or more.

* * * * *